United States Patent [19]

Murabito

[11] 4,091,557

[45] May 30, 1978

[54] SAFETY FOR A REVOLVER

[76] Inventor: Frank Murabito, 64-24 80th Ave., Glendale, N.Y. 11227

[21] Appl. No.: 733,964

[22] Filed: Oct. 19, 1976

[51] Int. Cl.[2] ..... F41C 17/08

[52] U.S. Cl. ..... 42/66

[58] Field of Search ..... 42/66, 62

[56] References Cited

U.S. PATENT DOCUMENTS

| | | | |
|---|---|---|---|
| 3,387,399 | 6/1968 | McClenahan | 42/62 |
| 3,628,278 | 12/1971 | Ruger | 42/66 |
| 3,978,603 | 9/1976 | Murabito | 42/66 |
| 3,988,847 | 11/1976 | Kennedy | 42/66 |

*Primary Examiner*—Charles T. Jordan
*Attorney, Agent, or Firm*—Allison C. Collard

[57] ABSTRACT

The invention is concerned with a safety for a revolver in which the release button or thumb piece is provided with three positions, one of which is the normally open and non-firing position, a second of which is an intermediate, but normally closed, non-firing position, and a third of which is the normally closed and firing position. A spring mechanism is provided to hold the release button in its intermediate position while permitting movement to the first or normally open, or non-firing position, but preventing movement to the third or normally closed position or firing position. The button is connected with the conventional pawl blocking mechanism which prevents the firing of the ammunition when the button is in the intermediate or normally open position. In the intermediate position, while the mounting cylinder is closed, the pawl blocking mechanism prevents the pawl from actuating the ammunition in response to movement of the triggering mechanism, so as to provide for a safety while permitting the gun to be in a ready to fire position. The mechanism also includes a button engaging element which is held in place by means of a spring device, and a lever is attached to the bar to overcome the spring force so as to permit the button to be moved to the normally firing position.

9 Claims, 5 Drawing Figures

SAFETY FOR A REVOLVER

The present invention relates to revolvers and in particular to a safety for revolvers.

In general, revolvers are not provided with any satisfactory safety. The lack of safety means that there may be an accidental discharge of the revolver, while in a holster or otherwise. The problem with the design of such a safety device has been one of weight and space, since a revolver has to be designed to have a minimum weight and space. There has been no satisfactory noncumbersome safety for a revolver which will prevent accidental firing when it is fully loaded and otherwise in a condition ready for use.

It is therefore an object of the present invention to provide a safety device for revolvers which can inactivate the hammer or the pawl mechanism related to the hammer while maintaining the revolver in a closed condition with the cartridge cylinder fully loaded and ready to fire.

It is another object of the present invention to provide a safety for revolvers which is extremely compact and lightweight, constituting only a simple modification of a conventional revolver and which can operate satisfactorily to achieve the function desired, and is inexpensive to make.

Known revolvers such as the "Ruger Double Action Revolver" available from the Sturm Ruger and Company of Southport, Conn., USA are provided with a thumb piece which is movable from a normally open condition to a normally closed condition, but there is no intermediate or safety position.

In accordance with the present invention there is provided an undercut or notch on the thumb piece which is adapted to be engaged by a bar element to maintain the thumb piece in an intermediate safety position. The present invention also includes a housing for mounting the bar onto the handle of the gun and maintaining the bar in engagement with the thumb piece to prevent movement thereof to a fully locked or firing position, but permitting the movement of the thumb piece to a fully open or unlocked condition. The bar is also provided with a lever mechanism by means of which the bar may be moved out of engagement with the thumb piece so that the thumb piece can be moved from the safety position to the normal firing position. The present invention provides for the maintenance of the normal pawl blocking element provided in a Ruger type gun so as to prevent the pawl element from being moved in response to activation thereof by the trigger mechanism to fire the firing pin.

Other objects and features of the present invention will become apparent from reference to the drawing which discloses a preferred embodiment of the gun in which.

Figure 1:
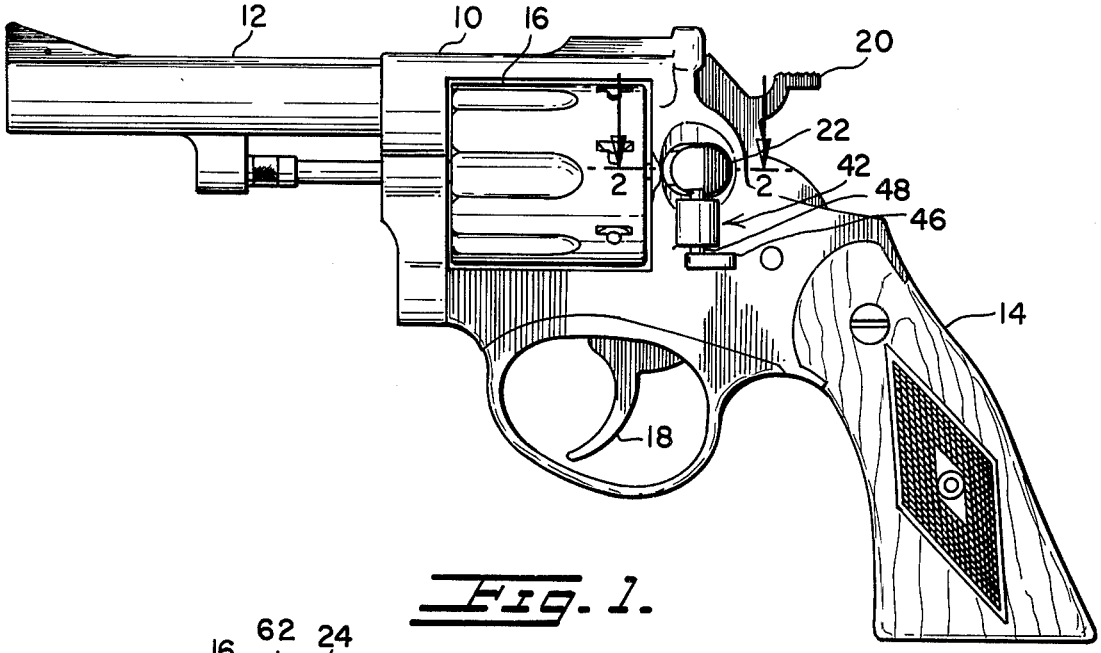
FIG. 1 is a side elevational view of a conventional "Ruger" double action revolver showing the portion of the thumb piece and the lever in accordance with the present invention as a safety when the gun is loaded and with the thumb piece in an intermediate position.

Referring now to the drawing, and more particularly to FIG. 1, a "Ruger" double action revolver is illustrated which is available from Sturm Ruger & Co., Inc., Southport, Conn. Reference is also made to the instructions and parts list having a designation D/20/1-75 for a more complete detailed disclosure of all the integral parts, the details of which have been omitted from the present disclosure as they are not considered necessary for the description of the invention but are desirable for a more detailed understanding of the specific operation of the revolver. The revolver includes a body 10 having a barrel 12 connected to the body, and a handle 14 connected to the rear end thereof.

Figure 3:
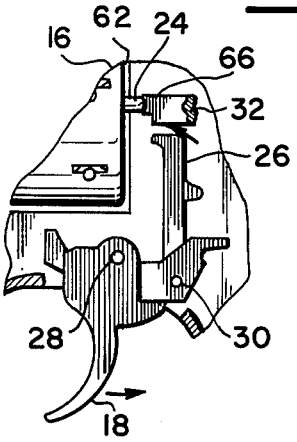
FIG. 3 is a section taken along lines 3—3 of FIG. 2, showing the internal safety element in a position to prevent the hammer from hitting or engaging the firing pin.
Figure 2:
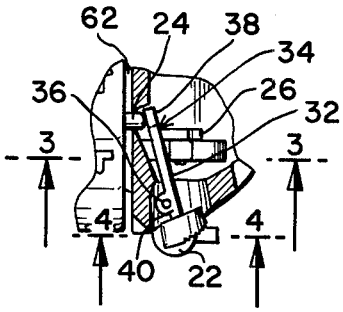
FIG. 2 is a section taken along lines 2—2 of FIG. 1.

The additional conventional features of the revolver are a mounting cylinder 16 containing the ammunition, a trigger 18, and a hammer 20 operatively connected with trigger 18 in a known manner. There is a thumb piece or cylinder release button 22 proximate to the handle 14 for locking the mounting cylinder in place and, as best seen in FIGS. 2 and 3, a cylinder release pin 24 adapted to cooperate with the cylinder release button 22 for movement thereof to a position from a locked condition of the mounting cylinder 16 to an unlocked condition thereof. The revolver also includes a pawl 26 for rotating the mounting cylinder 16 when trigger 18 is pulled to fire a round of ammunition. For this purpose, a trigger pivot pin 28 is provided to pivot trigger 18 to body 10, and a pawl pivot pin 30 is provided to raise and permit rotation of pawl 26 and move it in a sloping path as shown by the arrow in FIG. 3 to index the mounting cylinder.

Mounted within handle portion 14 is a blocking element 32 which engages the cylinder release pin 24 to permit the mounting cylinder to be opened, as will be explained further hereinafter. Blocking element 32 also interferes with the movement of pawl 26 to prevent the pawl from hitting the firing pin when the blocking element 32 is in the pathway of the pawl, when the button 22 is in an unlocked position of the mounting cylinder 16. And, as will be explained further hereinafter, when blocking element 32 is not completely move out of the path of pawl 26, it is not possible to fire the revolver.

Blocking element 32 as best seen in FIG. 2, includes an elongated member 34 pivotably connected by means of pivot 36 to an internal portion of the handle, and includes a first arm 38 and a second arm 40. The second arm 40 is connected with the release button 22; the blocking member 32 together with the release button 22 form a unitary whole to control the internal movement of the cylinder release pin 24 and acts to move into the path of movement of the pawl 26.

Figure 4:
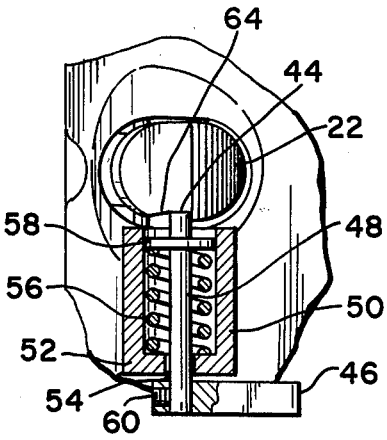
FIG. 4 is a section taken along lines 4—4 of FIG. 2.
Figure 5:
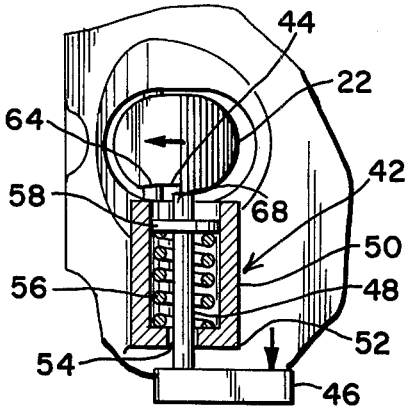
FIG. 5 is a sectional view similar to that of FIG. 4, but showing the thumb piece and the lever in its completely locked condition with the gun ready for firing.

Referring now more particularly to FIG. 1 and FIGS. 4 and 5 of the drawing which shows the safety mechanism 42 according to the present invention which includes the button 22, but modified to provide for an undercut portion or notch element 44, a safety lever 46 is arranged for activation or movement by the digits or thumb of the gun user and adapted to carry or be connected with a bar element 48 capable of moving into and out of engagement with the notch element 44.

The release button 22 is provided with three different conditions of rest or positions on the handle of the revolver. The first position is the normally open position or condition in which the mounting cylinder 16 may be opened to remove and/or insert ammunition and can also be considered a non-firing condition. The second position is the normally-closed position or condition in which the mounting cylinder is in a position for firing or actuation. This is the condition shown in FIG. 5 with the button 22 not held by the bar element 48 and also designated for purposes of explanation, as the safety release position or condition. The third position or condition is the intermediate or safety position specially provided in accordance with the present invention, and designated as a safety engaged position or condition. This is best seen in FIG. 4 with the button held in an intermediate position by means of the bar element 48 being held in engagement with the undercut or notch element 44. This maintains the mounting cylinder 16 in a locked condition ready for firing and at the same time prevents the firing pin from being activated by the pawl 26 as a result of the interposition of the blocking element 32.

The safety mechanism 42 generally includes a compartment 50 cast in place in or on the handle portion 14. It also includes a base portion 52 having an opening 54 through which the bar element 48 is adapted to move in response to movement by the safety lever 46. A compression spring 56 is positioned in place about the bar 48 within the compartment 50 and held in place about the bar element 48 by means of two bearing members, one of which is a spring bearing plate 58 which is fixedly attached to the bar element 48 at a point remote from the base 52 and the connection of the bar element 48 to the safety lever 46 and the other of which bearing member is the base portion 52 of the compartment 50. Compression spring 56 bears against the spring bearing plate 58 for movement of the bar element 48 into engagement with the undercut portion 44 of the thumbpiece 22 to prevent forward movement thereof in the direction shown by the arrow in FIG. 5.

For ease of disassembly of the safety mechanism 42, a set screw 60 is provided for attachment of the lever 46 onto the bar element 48.

Lever 46 when moved in a direction of the vertical arrow shown in FIG. 5, moves bar element 48 against the action of compression spring 56 for further compression thereof and out of engagement with the notch element 44, so that the release button 22 may be moved in a direction of the horizontal arrow as shown in FIG. 5 from the second or safety engaged position or intermediate position of FIG. 4 to the third position or the safety-released or position of FIG. 5 with the pawl now being unblocked and free to move to fire the ammunition while maintaining the mounting cylinder 16 in its locked condition.

In the conventional revolver, a space 62 is provided between the mounting cylinder 16 and the housing of the revolver, through which the cylinder release pin 24 is spring-urged to maintain the mounting cylinder in a locked condition. In the normally-open position of the mounting cylinder 16, not shown, the release button 22 is moved past the FIG. 4 position, a sliding portion 64 provided on the button 22 is effective to overcome the spring force applied to the bar 48 in a conventional manner, to permit the button 22 to slide on the sliding portion 64, and further the cylinder release pin 24 is moved past the space 62 in a conventional manner to permit opening of the mounting cylinder 16. The top of the bar is provided with a sliding surface 68 along which the sliding portion 64 is adapted for free sliding movement when the bar 48 is engaged with the notch element or undercut portion 44.

Referring now more particularly to FIGS. 2 and 3 of the accompanying drawing, the elongated member 34 is shown in its intermediate or safety condition preventing the pawl 26 from rotating the cylinder 16. The first arm 38 is connected to an L-shaped camming portion 66 for engagement with the release pin 24. The second arm 40 on the other side of the pivot 36 is connected with the cylinder release button 22, such that movement of the button 22 to the left in the direction of the arrow moves, the first arm 38 out of the path of travel of the pawl 26 and permits pawl 26 to rotate the mounting cylinder 16 when the trigger 18 is pulled to fire a round of ammunition.

With the release button 22 held in the intermediate position, the mounting cylinder 16 is in a locked condition ready for firing, but the gun cannot be fired. The bar 48 is engaged with the notch element 44 and in this position causes the L-shaped camming element 66 to be engaged with the cylinder release pin 24, but insufficient to overcome the conventional spring pressure holding the cylinder release pin 24 in its condition locking the mounting cylinder 16. When the release button 22 is held in its intermediate position, it also is positioned to prevent movement of pawl 26 into its position to index the mounting cylinder 16. Consequently, any movement of trigger 18 or actuation thereof is ineffective to fire a round of ammunition. As best seen in FIG. 2, the first arm 38 of the blocking element 32 prevents the pawl 26 from moving therepast, so that the gun is maintained in its safety or intermediate position.

When it is desired to fire the gun, the safety lever 46 is released by movement in a vertically downward direction to overcome the compression spring 56 and permit the button 22 to ride over and past the bar element 48 so that the conventional blocking element 32 is moved out of the path of pawl 26. Of course, blocking element 32 blocks pawl 26 when the button 22 is moved to its first or normally open position.

It will be evident that applicant has provided a novel safety for a revolver heretofore described without interfering with the internal parts or the normal operation thereof.

It will be obvious to those skilled in the art that many changes and modifications may be made thereunto without departing from the spirit and scope of the invention.

What is claimed is:

1. A safety for a revolver of the type including a mounting cylinder adapted to contain ammunition, a handle connected with the mounting cylinder and including a mounting cylinder release button, a triggering mechanism including a pawl in the handle for rotating the mounting cylinder, a pawl blocking element carried by said handle and connected with the release button, said button being movable from a normally open position whereby to permit opening of the mounting cylinder, to an intermediate safety non-firing condition, and to a normally closed position to permit firing of ammunition in the mounting cylinder, the pawl blocking element being movable with said button such that in the normally open position thereof, said pawl blocking element prevents the pawl from rotating said mounting cylinder in response to activation of said triggering mechanism and permits the ammunition to be fired in the normally closed position of the button, said safety comprising:

a notch element provided on said button, said button having three positions of rest, one being said normally open position, the second being said safety condition and the third being said normally closed position; and means adapted to engage said button for maintenance thereof in said safety position and movable out of engagement therewith to permit movement of said button to said other positions said means including a bar element support for movement on said handle, and a lever coupled to said bar element for movement of said bar element out of engagement with said notch element for movement of said button to said normally closed position.

2. A safety as claimed in claim 1, wherein said button includes a sliding portion adapted to engage and slide along the top of said bar element.

3. A safety as claimed in claim 1, wherein said pawl blocking element is connected with said button and moves internally of the handle to prevent the pawl from rotating said mounting cylinder in said safety condition of said button.

4. A safety as claimed in claim 1, wherein said means includes a compartment carried by said handle, and having a base portion provided with an opening therethrough, a bar element movable within said compartment and having one end extending through said opening and another end adapted for engagement with said notch element, a compression spring carried by said bar element having one end in engagement with said base, and a spring bearing plate in said compartment carried by said bar element proximate to said other end thereof for engagement with said other end of said spring for urging said bar element into engagement with said notch element.

5. A safety as claimed in claim 4, including a lever coupled to said one end of said bar element externally of said compartment.

6. A safety as claimed in claim 5, said button including a sliding portion, said other end of said bar element including a sliding surface adapted to engage said sliding portion and being held thereagainst under the action of said compression spring but permitting said button to be moved to said first normally open position.

7. An improved safety for a revolver of the type including a handle, a release button carried on the handle of the revolver and connected with a pawl blocking mechanism for preventing the firing of the revolver, said release button being movable from a first position, in which it permits a mounting cylinder to be opened, to an intermediate second position to permit the revolver to be in a condition ready to be fired but to prevent the firing thereof, to a third position to permit the firing thereof, the improvement comprising:

said button including a notch element, and a bar element supported for movement on the handle of the revolver for engagement with said notch element to prevent movement of said button from said second position to said third position, but to permit movement to said first position to permit the mounting cylinder to be opened.

8. A safety as claimed in claim 7, including a compartment carried by said handle and having a base portion provided with an opening therethrough, said bar element being movable within said compartment and having one end extending through said opening and another end adapted for engagement with said notch element, a compression spring carried by said bar element having one end in engagement with said base, a spring bearing plate in said compartment and fixedly attached to said bar element proximate to said other end thereof for engagement with said other end of said spring for urging said bar element into engagement with said notch element, and a lever coupled to said one end of said bar element which extends externally of said compartment for movement of said bar element to overcome the force of said compression spring whereby to move said bar element out of engagement with said release button thereby to permit movement of said release button to said third position, and said button including a sliding portion, and said other end of said bar element including a sliding surface adapted to engage said sliding portion and being held thereagainst under the action of said compression spring but permitting said button to be moved from said second intermediate position in which said pawl blocking mechanism is positioned for the prevention of the firing of the revolver to said first position to permit the mounting cylinder to be opened.

9. A safety as claimed in claim 7, including a compression spring carried by said bar element adapted to urge said bar element into engagement with said notch element, and a lever coupled to said bar element for moving said bar element out of engagement with said notch element.

* * * * *